US007435906B2

(12) United States Patent
Yasuda et al.

(10) Patent No.: US 7,435,906 B2
(45) Date of Patent: Oct. 14, 2008

(54) TOUCH PANEL, TRANSPARENT CONDUCTOR AND TRANSPARENT CONDUCTIVE FILM USING THE SAME

(75) Inventors: Noriyuki Yasuda, Tokyo (JP); Youichi Kobayashi, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 11/509,639

(22) Filed: Aug. 25, 2006

(65) Prior Publication Data

US 2007/0045593 A1 Mar. 1, 2007

(30) Foreign Application Priority Data

Aug. 31, 2005 (JP) ..... P2005-251478

(51) Int. Cl.
*H01B 1/00* (2006.01)

(52) U.S. Cl. ..... 174/94 R; 174/102 SC

(58) Field of Classification Search ..... 174/94 R, 174/102 SC
See application file for complete search history.

(56) References Cited

U.S. PATENT DOCUMENTS

| | | | | |
|---|---|---|---|---|
| 5,492,762 | A * | 2/1996 | Hirai et al. | 428/447 |
| 6,086,790 | A * | 7/2000 | Hayashi et al. | 252/500 |
| 6,180,030 | B1 * | 1/2001 | Hirai et al. | 252/512 |
| 2004/0265602 | A1 * | 12/2004 | Kobayashi et al. | 428/458 |
| 2005/0233131 | A1 * | 10/2005 | Nishida et al. | 428/323 |

FOREIGN PATENT DOCUMENTS

| | | |
|---|---|---|
| JP | B 3072862 | 6/2000 |

* cited by examiner

*Primary Examiner*—Chau N Nguyen
(74) *Attorney, Agent, or Firm*—Oliff & Berridge, PLC

(57) ABSTRACT

In a transparent conductor containing conductive particles and a binder, the conductive particles have an average particle size of 60 nm or smaller, and the number of conductive particles having an average particle size of 100 nm or greater is 10% or less of the total number of conductive particles.

4 Claims, 3 Drawing Sheets

TOUCH PANEL, TRANSPARENT CONDUCTOR AND TRANSPARENT CONDUCTIVE FILM USING THE SAME

BACKGROUND OF THE INVENTION

1. Field of the Invention

The present invention relates to a transparent conductor and a transparent conductive film using the same.

2. Related Background Art

In general, a panel switch such as touch panel is constructed by a pair of transparent electrodes opposing each other and a spacer held between the pair of transparent electrodes. When one of the transparent electrodes is pushed in such a panel switch, this transparent electrode comes into contact with the other transparent electrode, so as to conduct electricity, whereby the position of the point of contact is detected. Employed as the transparent electrode is a transparent conductive film, whereas the transparent conductive film has a transparent conductor in which conductive particles are dispersed in a binder.

In general, conductive particles are dispersed in such a transparent conductor. However, in general, each conductive particle is a secondary particle into which primary particles flocculate. When light is incident on the transparent conductor, the conductive particles scatter the light, thereby lowering the light transmittance and haze value of the transparent conductor. Therefore, transparent conductors having a sufficient light transmittance and haze value have been in demand.

As such a transparent conductor, a transparent conductor in which the volume content of conductive particles is 50 to 80%, for example, has conventionally been disclosed, and it has been proposed to improve the light transmittance and haze value by this transparent conductor (see Japanese Patent No. 3072862). Here, ultrafine particles of indium tin oxide having an average particle size of 30 nm are employed as the conductive particles.

SUMMARY OF THE INVENTION

However, the transparent conductive film disclosed in the above-mentioned Japanese Patent Publication No. 3072862 may fail to exhibit sufficient light transmittance and haze value, and may be unsuitable as a film used for panel switches in particular.

In view of the foregoing circumstances, it is an object of the present invention to provide a transparent conductor which can reliably realize sufficient light transmittance and haze value, and a transparent conductive film using the same.

The inventors conducted diligent studies in order to solve the problems mentioned above and, as a result, found that not only the average particle size of conductive particles but also their particle size distribution is important for improving the light transmittance and haze value. The inventors have further conducted diligent studies and found that the above-mentioned problems can be solved when the conductive particles have an average particle size of a predetermined value or smaller while the ratio of conductive particles having a predetermined particle size or greater is a predetermined value or smaller in the particle size distribution of conductive particles, thereby completing the present invention.

Namely, in one aspect, the present invention provides a transparent conductor containing conductive particles and a binder, wherein the conductive particles have an average particle size of 60 nm or smaller, and wherein the number of conductive particles having an average particle size of 100 nm or greater is 10% or less of the total number of conductive particles. Here, the transparent conductor in the present invention encompasses film- and sheet-like transparent conductors, in which the film-like transparent conductors refer to those having a thickness falling within the range of 50 nm to 1 mm, whereas the sheet-like transparent conductors refer to those having a thickness exceeding 1 mm.

In this transparent conductor, the average particle size is 60 nm or smaller, whereas the number of conductive particles having an average particle size of 100 nm or greater is 10% or less of the total number of conductive particles, so that the conductive particles have a small particle size on the whole while the ratio of conductive particles having a particle size of 100 nm or greater that become a main cause of light scattering is sufficiently small. Therefore, light incident on the transparent conductor of the present invention is sufficiently restrained from scattering. This can reliably realize sufficient light transmittance and haze value.

When the average particle size of the conductive particles exceeds 60 nm, sufficient light transmittance and haze value cannot be realized reliably. When the number of conductive particles having a particle size of 100 nm or greater exceeds 10% of the total number of conductive particles, the light transmittance and haze value decrease remarkably.

Preferably, in the transparent conductor, the number of conductive particles having a particle size of 40 to 80 nm is 50% or greater of the total number of conductive particles. In this case, incident light is further restrained from scattering, whereby the light transmittance and haze value can be improved more.

Preferably, in the transparent conductor, the conductive particles have an average particle size of 10 nm or greater. This can more fully suppress the change in conductivity caused by a reaction of the conductive particles with oxygen.

In another aspect, the present invention provides a transparent conductive film comprising a support and the transparent conductor provided on the support. This transparent conductive film has the above-mentioned transparent conductor, and thus is excellent in light transmittance and haze value. Therefore, this transparent conductive film is favorably used for touch panels and the like.

The present invention can provide a transparent conductor which can reliably realize sufficient light transmittance and haze value, and a transparent conductive film using the same.

DESCRIPTION OF THE PREFERRED EMBODIMENTS

Figure 1:
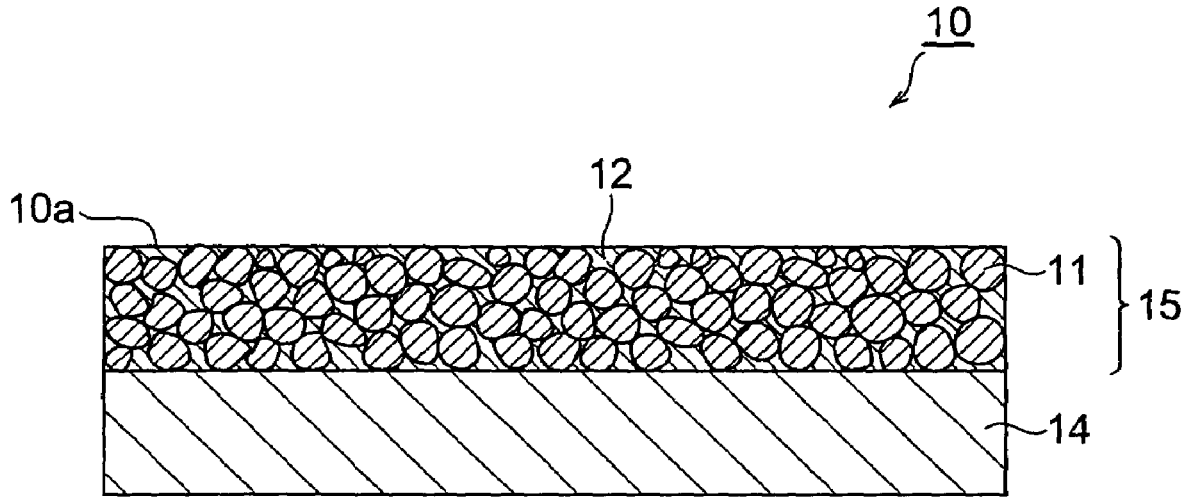
FIG. 1 is a schematic sectional view showing a first embodiment of the transparent conductive film in accordance with the present invention.

In the following, preferred embodiments of the present invention will be explained in detail with reference to the drawings as necessary. In the drawings, the same constituents will be referred to with the same numerals without repeating their overlapping descriptions. Ratios of sizes in the drawings are not limited to those depicted.

[First Embodiment]

FIG. 1 is a schematic sectional view showing a first embodiment of the transparent conductive film in accordance with the present invention. As shown in FIG. 1, the transparent conductive film 10 in accordance with this embodiment comprises a support 14 and a transparent conductor 15 provided on the support 14. The transparent conductor 15 contains conductive particles 11 and a binder 12, whereas the transparent conductor 15 is filled with the conductive particles 11 such that the conductive particles 11 adjacent to each other are in contact with each other. This enables conduction in the transparent conductor 15.

The transparent conductor 15 will now be explained in further detail.

Transparent Conductor

The transparent conductor 15 usually contains the conductive particles 11 and the binder 12.

Conductive Particles

The conductive particles 11 are constructed by a transparent conductive oxide material. The transparent conductive oxide material is not restricted in particular as long as it is transparent and conductive. Examples of the transparent conductive oxide material include indium oxide; indium oxide doped with at least one species of elements selected from the group consisting of tin, zinc, tellurium, silver, gallium, zirconium, hafnium, and magnesium; tin oxide; tin oxide doped with at least one species of elements selected from the group consisting of antimony, zinc, and fluorine; zinc oxide; and zinc oxide doped with at least one species of elements selected from the group consisting of aluminium, gallium, indium, boron, fluorine, and manganese.

Preferably, the filling ratio of the conductive particles 11 in the transparent conductor 15 is 10 vol % to 70 vol %. When the filling ratio is less than 10 vol %, the electric resistance value of the transparent conductor 15 tends to become higher than in the case where the filling ratio falls within the range mentioned above. When the filling ratio exceeds 70 vol %, the mechanical strength of the conductive particle 15 tends to decrease as compared with the case where the filling ratio falls within the range mentioned above.

Preferably, the conductive particles 11 have a specific surface area of 10 to 50 $m^2/g$. When the specific surface area is less than 10 $m^2/g$, the scattering of visible light tends to become greater than in the case where the specific surface area falls within the range mentioned above. When the specific surface area exceeds 50 $m^2/g$, the transparent conductive material tends to lower its stability as compared with the case where the specific surface area falls within the range mentioned above. Here, the specific surface area refers to a value measured by a specific surface area measuring apparatus (type: NOVA2000 manufactured by Quantachrome Instruments) after drying a sample in vacuum for 30 minutes at 300° C. However, the object of the present invention is achievable even when the specific surface area of the conductive particles 11 is outside of the above-mentioned range.

Figure 2:
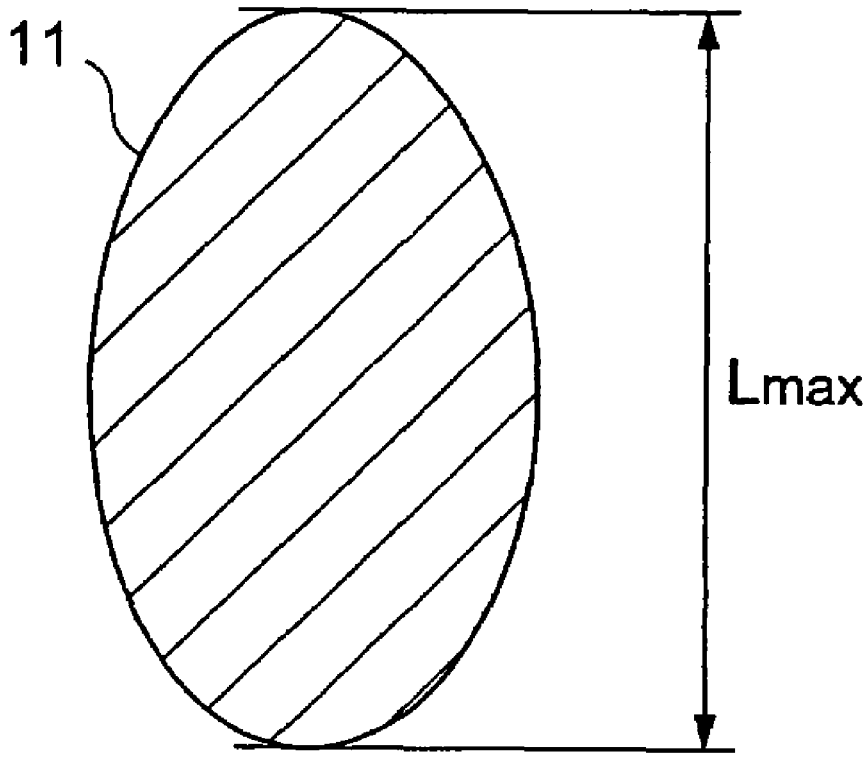
FIG. 2 is a view for explaining the particle size of a conductive particle.

The conductive particles 11 have an average particle size of 60 nm or smaller. Here, the average particle size is a value measured by using transmission electron microscopy (TEM). Namely, the average particle size is a value calculated by cutting the transparent conductor 15, observing 150 conductive particles 11 on the cut plane, measuring the maximum particle size Lmax in each of the conductive particles 11 (see FIG. 2), and averaging thus measured values.

When the average particle size exceeds 60 nm, light scattering becomes greater than that in the case where the average particle size falls within the range mentioned above, so that the light transmittance in the transparent conductor 15 decreases, thereby increasing the haze value. Preferably, the average particle size is 10 nm or greater. When the average particle size is less than 10 nm, the conductivity of the transparent conductor 15 is more likely to decrease than in the case where the average particle size falls within the range mentioned above. Namely, while oxygen defects occurring in the conductive particles 11 generate conductivity in the transparent conductor 15 in accordance with this embodiment, the oxygen defects decrease, for example, when the external oxygen concentration is high in the case where the average particle size of the conductive particles 11 is less than 10 nm, whereby the conductivity may become lower.

In the transparent conductor 15, the number of conductive particles 11 having a particle size of 100 nm or greater is 10% or less of the total number of conductive particles 11. When this ratio exceeds 10%, the light transmittance and haze value of the transparent conductor 15 decrease remarkably.

Preferably, the particle size of the conductive particles 11 is 40 to 80 nm. The lower limit of the particle size is thus set to 40 nm in order to secure stability in the resistance value of the transparent conductor, whereas the upper limit is set to 80 nm since it becomes a threshold at which optical properties (optical transmission and haze value) greatly change. However, the object of the present invention is achievable even when the particle size of the conductive particles 11 is outside of the above-mentioned range.

The form of the conductive particles 11 is not limited in particular as long as their average particle size and maximum particle size fall within the respective ranges mentioned above. Examples of forms of the conductive particles 11 include spheres, ellipsoids, and amorphous forms obtained when they are fused together.

Thus, in the transparent conductor 15 in accordance with this embodiment, the average particle size is 60 nm or smaller, whereas the number of conductive particles 11 having a particle size of 100 nm or greater is 10% or less of the total number of conductive particles 11, so that the conductive particles 11 have a small particle size on the whole while the ratio of conductive particles 11 having a particle size of 100 nm or greater that become a main cause of light scattering is sufficiently small. Therefore, light incident on the transparent conductor 15 of the present embodiment is sufficiently restrained from scattering. This can reliably realize sufficient light transmittance and haze value.

The average particle size and particle size distribution of the conductive particles 11 can be adjusted in the following manner. Namely, raw materials for the conductive particles 11 are pulverized in a pulverizer such as homomixer, bead mill, ball mill, colloid mill, air flow pulverizer, medialess mill, or ultrasonic disperser, whereby the average particle size and particle size distribution can be adjusted.

Preferably, a bead mill pulverizer which pulverizes conductive particles in a liquid is used as the pulverizer. In this case, the range of particle size distribution in the resulting conductive particles can be made narrower.

Preferably, the beads used in the bead mill pulverizer have a diameter of 15 to 50 μm. This can yield conductive particles having a smaller average particle size.

When the conductive particles include those having a greater particle size after the pulverization mentioned above, the conductive particles having a greater particle size may be separated by centrifugation, electrophoresis, filtration, or the like.

When performing centrifugation, for example, conductive particles having a predetermined particle size can be separated by adjusting the number and time of rotations of a centrifuge, whereby the average particle size and particle size distribution of conductive particles can be regulated. When performing electrophoresis, the average particle size and particle size distribution can be regulated by adjusting current, time, and the like. When performing filtration, the average particle size and particle size distribution can be regulated by adjusting the pore size of a filter employed.

Binder

The binder 12 is not limited in particular as long as it can secure the conductive particles 11. Examples of the binder 12 include acrylic binders, epoxy binders, polystyrene, polyurethane, silicone binders, and fluorine binders.

Among them, acrylic binders are preferably used as the binder 12. This can improve the light transmittance of the transparent conductive film 10 more. Namely, the transparent conductive film 10 containing an acrylic binder as the binder 12 can improve its transparency more. Acrylic binders are also excellent in chemical resistances to acids and alkalis and scratch resistance (surface hardness). Therefore, the transparent conductive film 10 containing an acrylic binder in the transparent conductor 15 is more favorably used in a touch panel or the like which is supposed to be wiped with a wiping agent containing an organic solvent, a surfactant, or the like or have the surface 10*a* coming into contact with or be rubbed against the surface 10*a* of its opposing transparent conductor 15.

The binder 12 is manufactured by polymerizing a radically polymerizable compound, an ionically polymerizable compound, or a thermally polymerizable compound. The radically polymerizable compound refers to an organic compound which is polymerized by a radical. The ionically polymerizable compound refers to an organic compound which is polymerized by a cation. The thermally polymerizable compound refers to an organic compound which is polymerized by heat. These organic compounds contain a substance to become a raw material for the binder 12. Specifically, they contain monomers, dimers, trimers, oligomers, and the like which can form the binder 12.

Among them, monomers of a radically polymerizable compound or monomers of an ionically polymerizable compound are used preferably. This is advantageous in that the process management becomes easier, since the polymerization reaction can be controlled, while polymerization can be achieved in a short time. More preferably, among the monomers mentioned above, monomers of a radically polymerizable compound are used. This is advantageous in that the reproducibility in film thickness and the dimensional precision in the transparent conductor 15 are easier to attain than in the case of ionic polymerization of the monomers of the ionically polymerizable compound, since the monomers of the radically polymerizable compound are polymerized together instantaneously upon irradiation with light. It will be sufficient if such monomers of the radically polymerizable compounds contain a vinyl group or its derivatives. Their specific examples include acrylic acid and its derivatives, methacrylic acid and its derivatives, and styrene and its derivatives. They may be used singly or in mixtures of two or more species.

Preferably, the refractive index of the transparent conductor 15 is 1.5 or less. When the refractive index is less than 1.5, the reflectance decreases more than in the case where the refractive index is 1.5 or greater, whereby transparency tends to improve more.

Preferably, the thickness of the transparent conductor 15 is 0.1 to 5 μm. When the thickness is less than 0.1 μm, the resistance value tends to be harder to stabilize than in the case where the thickness falls within the range mentioned above. When the thickness exceeds 5 μm, the transparency tends to decrease more than in the case where the thickness falls within the range mentioned above. However, the object of the present invention is achievable even when the thickness of the transparent conductor 15 is outside of the above-mentioned range.

Preferably, the transparent conductor 15 has a Tg of 30° C. or higher. The Tg of 30° C. or higher can maintain the morphology of the transparent conductor 15 even when the latter is used for a long period.

Support

The transparent conductive film 10 of this embodiment is provided with the support 14. The support 14 is not limited in particular as long as it is constructed by a material transparent to high-energy lines which will be explained later and visible light. Namely, the support 14 may be a known transparent film. Examples of such a transparent film include films of polyesters such as polyethylene terephthalate (PET), films of polyolefins such as polyethylene and polypropylene, polycarbonate films, acrylic films, and norbornene films (e.g., ARTON manufactured by JSR Corporation). Not only the resin films, but glass may also be used as the support 14.

Preferably, the support 14 is made of a resin alone. This makes the transparent conductive film 10 better in transparency and bendability than in the case where the support 14 contains a resin and other components. Therefore, the transparent conductive film 10 using the support 14 made of a resin alone is effective in particular for use in panel switches such as touch panels, for example.

Intermediate layers may further be provided between the support 14 and transparent conductor 15. The number of intermediate layers is not limited in particular, whereas they may be provided as necessary. Examples of the intermediate layers include layers functioning as buffer layer, conductive auxiliary layer, dispersion prevention layer, UV-blocking layer, coloring layer, and polarizing layer. Preferably, these layers are constructed by a resin, an inorganic oxide, or their composite.

The transparent conductive film 10 in accordance with this embodiment has the transparent conductor 15, and thus can reliably realize sufficient light transmittance and haze value.

Manufacturing Method

A method of manufacturing the transparent conductive film 10 in accordance with this embodiment in the case using tin-doped indium oxide (hereinafter referred to as "ITO") as the above-mentioned conductive particles 11 will now be explained.

To begin with, a support 14 is mounted on a glass substrate which is not depicted, and a transparent conductor 15 containing conductive particles 11 and a binder 12 is formed on the support 14. A method of manufacturing the conductive particles 11 will now be explained.

First, indium chloride and tin chloride are coprecipitated by neutralization with an alkali (precipitating step). Here, the salt yielded as a byproduct is eliminated by decantation or centrifugation. Thus obtained coprecipitate is dried, and the resulting dried product is fired in an atmosphere and pulverized. This manufactures conductive particles. It will be preferred from the viewpoint of controlling oxygen defects if the firing is performed in a nitrogen atmosphere or in an atmosphere of a rare gas such as helium, argon, or xenon.

Thus obtained conductive particles are dispersed into water, and a bead mill pulverizer, for example, is used such that the average particle size is 60 nm or smaller, while the number of conductive particles having a particle size of 100 nm or greater is 10% or less of the total number of conductive particles. If necessary, the conductive particles may be subjected to filtering. Then, thus obtained conductive particles 11 and the binder 12 are mixed together and dispersed into a liquid, so as to yield a dispersion liquid. Examples of the liquid for dispersing the conductive particles 11 and binder 12 include saturated hydrocarbons such as hexane; aromatic hydrocarbons such as toluene and xylene; alcohols such as methanol, ethanol, propanol, and butanol; ketones such as acetone, methylethylketone, isobutylmethylketone, and diisobutylketone; esters such as ethyl acetate and butyl acetate; ethers such as tetrahydrofuran, dioxane, and diethyl ether; and amides such as N,N-dimethylacetamide, N,N-dimethylformamide, and N-methylpyrrolidone. The binder 12 may be dissolved in the above-mentioned liquid beforehand, and then the conductive particles 11 may be mixed into this liquid, so as to yield a dispersion liquid.

Subsequently, thus obtained dispersion liquid is applied onto the support 14. The support 14 can be provided beforehand with an anchor layer on the surface side to attach the transparent conductor 15. Providing the anchor layer beforehand on the support 14 can fix the transparent conductor 15 through the anchor layer on the support 14 more firmly. Polyurethane or the like is favorably used as the anchor layer.

Preferably, after being applied by coating, the dispersion liquid is dried, so as to yield an unpolymerized transparent conductor. Examples of the coating method include reverse rolling, direct rolling, blading, knifing, extrusion, nozzle method, curtaining, gravure rolling, bar coating, dipping, kiss coating, spin coating, squeezing, and spraying.

Then, the unpolymerized transparent conductor provided on the support 14 is polymerized. When the unpolymerized conductive layer contains a radically polymerizable component, this component is polymerized upon irradiation with high-energy lines, whereby the transparent conductor 15 is formed. When the unpolymerized transparent conductor contains an ionically polymerizable component, this component is polymerized by adding a cationic polymerization initiator thereto, whereby the transparent conductor 15 is formed. When the unpolymerized transparent conductor contains a thermally polymerizable component, this component is polymerized by heating, whereby the transparent conductor 15 is formed. The above-mentioned high-energy lines may be not only UV rays, but also electron beams, γ-rays, x-rays, and the like as long as they can generate a radical.

Thus, the transparent conductor 15 is formed on one surface of the support 14, whereby the transparent conductive film 10 shown in FIG. 1 is obtained. This transparent conductive film 10 is favorably used for panel switches such as touch panels and light-transmitting switches. For example, the transparent conductive film 10 is used as at least one of transparent electrodes in a touch panel comprising a pair of transparent electrodes opposing each other and a dot spacer held between the transparent electrodes. The transparent conductive film 10 is favorably usable in not only the panel switches but also antinoise components, heating elements, electrodes for EL, electrodes for backlight, LCD, PDP, and the like.

[Second Embodiment]

A second embodiment of the transparent conductor in accordance with the present invention will now be explained. Constituents identical or equivalent to those in the first embodiment will be referred to with numerals identical thereto without repeating their overlapping descriptions.

Figure 3:
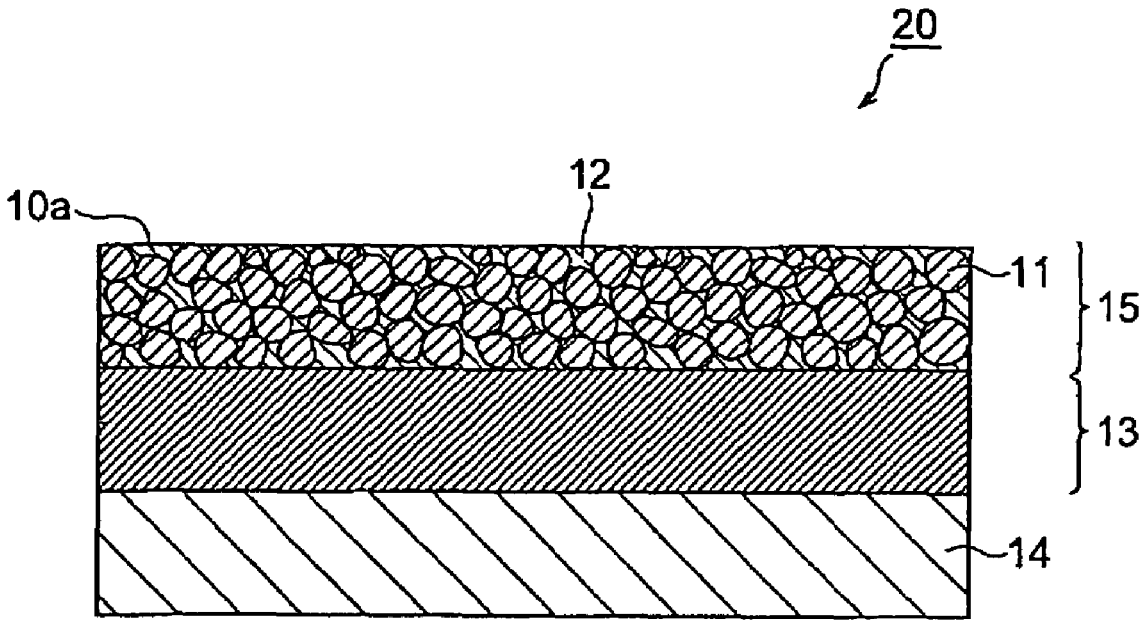
FIG. 3 is a schematic sectional view showing a second embodiment of the transparent conductive film in accordance with the present invention.

FIG. 3 is a sectional view showing the second embodiment of the transparent conductive film in accordance with the present invention. As shown in FIG. 3, the transparent conductive film 20 in accordance with this embodiment differs from the transparent conductive film 10 in accordance with the first embodiment in that it further comprises a binder layer 13 between the support 14 and transparent conductor 15. The binder layer 13 in accordance with the second embodiment is constructed by the above-mentioned binder 12.

Preferably, the refractive index of the binder layer 13 is 1.5 or less. When the refractive index is less than 1.5, the reflectance decreases more than in the case where the refractive index is 1.5 or greater, whereby transparency tends to improve.

Preferably, the thickness of the binder layer 13 is 0.1 to 5 μm. When the thickness is less than 0.1 μm, the electric resistance value tends to be harder to stabilize than in the case where the thickness falls within the range mentioned above. When the thickness exceeds 5 μm, the transparency tends to decrease more than in the case where the thickness falls within the range mentioned above. However, the object of the present invention is achievable even when the thickness of the binder layer 13 is outside of the above-mentioned range.

Manufacturing Method

A method of manufacturing the transparent conductive film 20 in accordance with this embodiment will now be explained.

First, conductive particles 11 are mounted on a glass substrate which is not depicted. Preferably, an anchor layer for securing the conductive particles 11 onto the substrate is provided on the substrate beforehand. When the anchor layer is provided beforehand, the conductive particles 11 can firmly be secured onto the substrate. The conductive particles 11 can be mounted easily. For example, polyurethane or the like is favorably used as the anchor layer.

For securing the conductive particles 11 onto the substrate, it will be preferred if the conductive particles 11 are compressed toward the substrate, so as to form a compressed layer. This is useful in that the conductive particles 11 can be attached to the substrate without forming the anchor layer. The compression can be effected by sheet pressing, roll pressing, and the like. It will also be preferred in this case if an anchor layer is provided beforehand on the substrate. This allows the conductive particles 11 to be secured more firmly. Not only glass, but films of polyester, polyethylene, and polypropylene, and various plastic supports, for example, are also usable as the substrate.

After thus forming the compressed layer of conductive particles 11 on the substrate, a transparent conductor 15 and a binder layer 13 are formed. As the binder 12, one curable by high-energy lines which will be explained later is used. When the binder 12 has such a high viscosity that it is hard to process, when the binder 12 is solid, and the like, the binder 12 is dispersed into a liquid, so as to form a dispersion liquid. Examples of the liquid for dispersing the binder 12 include saturated hydrocarbons such as hexane; aromatic hydrocarbons such as toluene and xylene; alcohols such as methanol, ethanol, propanol, and butanol; ketones such as acetone, methylethylketone, isobutylmethylketone, and diisobutylketone; esters such as ethyl acetate and butyl acetate; ethers such as tetrahydrofuran, dioxane, and diethyl ether; and amides such as N,N-dimethylacetamide, N,N-dimethylformamide, and N-methylpyrrolidone. The binder 12 may be dissolved in the liquid instead of being dispersed therein. Fillers and crosslinking agents may be added to the binder 12.

The binder 12 or the dispersion liquid of the binder 12 is applied by coating onto one surface of the compressed layer. Then, a part of the binder 12 infiltrates the compressed layer. Preferably, after coating, the dispersion liquid is subjected to a drying process. Examples of the coating method include reverse rolling, direct rolling, blading, knifing, extrusion, nozzle method, curtaining, gravure rolling, bar coating, dipping, kiss coating, spin coating, squeezing, and spraying.

Subsequently, a support 14 is attached onto the binder 12. The support 14 may be provided beforehand with an anchor layer on the surface to be attached to the binder 12. Providing the anchor layer beforehand on the support 14 allows the binder 12 to be fixed more firmly onto the support 14 through the anchor layer. Polyurethane and the like are favorably used as the anchor layer.

Next, high-energy lines are emitted from above the support 14 provided on the binder 12, so as to cure the binder 12 and a part of the binder 12 infiltrated in the compressed layer, thereby forming the transparent conductor 15 and binder layer 13. When a thermoplastic resin is used as a part of the binder 12 infiltrated in the compressed layer, it is cured by heating. Examples of the high-energy lines include UV rays, electron beams, γ-rays, and x-rays.

Subsequently, the substrate is peeled off from the transparent conductor 15, whereby the transparent conductor 15 and binder layer 13 are formed on one surface of the support 14. Thus, the transparent conductive film 20 shown in FIG. 3 is obtained.

Though preferred embodiments of the present invention are explained in the foregoing, the present invention is not limited to the above-mentioned embodiments.

The transparent conductor 15 in the first and second embodiments may contain the following optional components.

Optional Components

Fluorine Coating Agent

The transparent conductor 15 may contain a fluorine coating agent including a fluorine compound, whereas a surface 10*a* of the transparent conductor 15 may be coated with a fluorine coating agent.

In this case, since the fluorine coating agent includes a fluorine compound, the difference between refractive indexes of air and the transparent conductor 15 becomes smaller. Even when the transparent conductors 15 rub against each other, the surfaces of the transparent conductors 15 can be prevented from being shaved. Further, the transparent conductors shaved thereby can be prevented from attaching again, whereby the transparent conductor 15 adapted to suppress the fluctuation in electric resistance value can be obtained.

The fluorine compound is not limited in particular as long as it includes at least one fluorine atom in its molecule. Specific examples include perfluoropolyethers and their derivatives, fluorine-containing alcohols such as 2-perfluorodecylethanol, fluorine-containing acid halides such as perfluorooctanoyl fluoride, fluorine-containing acids such as perfluorodecanoic acid, fluorine-containing acrylates such as 2-(perfluorooctyl)ethyl acrylate, fluorine-containing methacrylates such as 2-(perfluoro-5-methylhexyl) ethyl methacrylate, perfluoro(2,5,8,11-tetramethyl-3,6,9,12-tetraoxapentadecanoyl) fluoride, perfluoropolyoxetanes and their derivatives, 3-perfluorohexyl-1,2-epoxypropane, di-heptadecatrifluorodecyldisilazane, heptadecatrifluorodecyltrimethoxysilane, and 1H, 1H-heptadecafluorononylamine. They may be used either singly or in mixtures of two or more species.

Preferably, the molecular weight of the fluorine compound is 200 to 20,000. When the molecular weight is less than 200, lubricity tends to become lower than in the case where the molecular weight falls within the range mentioned above. When the molecular weight exceeds 20,000, the electric resistance value tends to rise more than in the case where the molecular weight falls within the range mentioned above.

Preferably, the compounding amount of the fluorine compound is 5 to 70 parts by mass with respect to 100 parts by mass in total of the transparent conductor 15 and fluorine compound. When the compounding amount is less than 5 parts by mass, the effect of adding the fluorine compound is less likely to achieve than in the case where the compounding amount falls within the range mentioned above. When the compounding amount exceeds 70 parts by mass, the resistance value tends to increase more than in the case where the compounding amount falls within the range mentioned above.

Conductive Comipound

The transparent conductor 15 may contain a conductive compound. Specifically, it will be preferred if the conductive compound is constructed by at least one species of conductive polymer selected from the group consisting of polyacetylene, polypyrrole, polythiophene, polyphenylenevinylene, polyphenylene, polysilane, polyfluorene, and polyaniline, or at least one species of carbon material selected from the group consisting of activated carbon, carbon blacks such as acetylene black and Ketjenblack, graphite, carbon fired at low temperature, carbon easier to graphitize, carbon harder to graphitize, and carbon nanotubes.

When the conductive compound is the above-mentioned conductive polymer or carbon material, the electric compensation by these materials can be made more reliable. Namely, even when the distance between the conductive particles becomes wider, the resistance value can be prevented from changing. Therefore, in this case, the rise and temporal change in electric resistance value in the transparent conductor can fully be suppressed even in a highly humid environment or the like. Also, the above-mentioned conductive compound is poor in chemical reactivity to the binder, and thus can improve the durability of the transparent conductor 15.

Preferably, the conductive polymer is polythiophene. This makes it possible to form the transparent conductor 15 particularly excellent in light transmittance and conductivity.

Preferably, the carbon material is a carbon nanotube. Carbon nanotubes have a large aspect ratio in general, and thus are advantageous in that they can bring the conductive particles 11 into electric contact with each other.

Preferably, the compounding amount of the conductive compound is 2 to 10 parts by mass with respect to 100 parts by mass in total of the conductive particles 11 and conductive compound. When the compounding amount is less than 2 parts by mass, the electric compensation is harder to attain sufficiently than in the case where the compounding amount falls within the range mentioned above. When the compounding amount exceeds 10 parts by mass, the light transmittance tends to become lower than in the case where the compounding amount falls within the range mentioned above.

Preferably, the colloid of the conductive compound has a diameter of 5 nm to 50 nm. When the size of the colloid is 5 nm or less, the mechanical strength of the transparent conductor tends to become lower than in the case where the colloid form falls within the range mentioned above. When the size of the colloid exceeds 50 nm, the light transmittance tends to become lower than in the case where the colloid size falls within the range mentioned above. However, the object of the present invention is achievable even when the size of the colloid is outside of the above-mentioned range.

Filler

The transparent conductor 15 may contain a filler. This allows the binder layer 13 to maintain its morphology when a soft binder 12 is used for the binder layer 13.

Though not restricted in particular, organic fillers such as aramide, polystyrene beads, and acrylic beads; inorganic fillers such as silica, glass, alumina, zirconia, titania, ITO, tin oxide, and zinc oxide; and the like can be used as the filler.

Preferably used among them are inorganic fillers such as silica, glass, ITO, tin oxide, and zinc oxide. When the inorganic fillers are used, the transparent conductor 15 in accordance with this embodiment exhibits a high transparency.

More preferably used among the inorganic fillers are ITO, tin oxide, and zinc oxide. In this case, the inorganic fillers themselves exhibit conductivity, whereby the electric compensation of the resulting transparent conductor can be made more reliable. Namely, even when a crack or the like occurs in the transparent conductor so that the conductive particles 11 are out of contact with each other, conduction can be achieved through the inorganic fillers. This can restrain the transparent conductor 15 from raising its electric resistance value. The conductive inorganic fillers can be doped with one or a plurality of kinds of elements in order to improve the conductivity.

Preferably, the compounding amount of the filler is 0. 1 to 70 parts by mass with respect to 100 parts by mass in total of the binder 12, conductive particles 11, and filler. When the compounding amount is less than 0.1 part by mass, the morphology maintaining effect is harder to attain than in the case where the compounding amount falls within the range mentioned above. When the compounding amount exceeds 70 parts by mass, optical properties tend to become lower than in the case where the compounding amount falls within the range mentioned above.

Preferably, the filler has a particle size of 5 to 100 nm. When the particle size is 5 nm or less, it tends to become harder to disperse the filler uniformly into the binder layer 13 than in the case where the particle size falls within the range mentioned above. When the particle size exceeds 100 nm, optical properties tend to become lower than in the case where the particle size falls within the range mentioned above.

The transparent conductor 15 may further contain additives as necessary. Examples of the additives include surface-treating agents, crosslinking agents, photopolymerization initiators, fire retardants, UV-absorbing agents, colorants, and plasticizers in addition to the fluorine coating agent and conductive compound mentioned above.

EXAMPLES

In the following, the present invention will be explained more specifically with reference to examples, which do not restrict the present invention.

Making of Conductive Particles

An aqueous solution dissolving 19.9 g of indium chloride tetrahydrate (manufactured by Kanto Chemical Co., Inc.) and 2.6 g of stannic chloride (manufactured by Kanto Chemical Co., Inc.) into 980 g of water and a 10-fold water dilution of aqueous ammonia (manufactured by Kanto Chemical Co., Inc.) were mixed while being prepared, so as to produce a white precipitate (coprecipitate).

The liquid containing thus produced precipitate was subjected to solid-liquid separation by a centrifuge, so as to yield a solid. The solid was put into 1,000 g of water, dispersed by a homogenizer, and then subjected to solid-liquid separation by the centrifuge. After performing five sets of dispersion and solid-liquid separation, the solid was dried, and then was heated for 1 hour at 600° C. in a nitrogen atmosphere, so as to yield ITO powder (conductive particles).

Example 1

In a rectangular film. of polyethylene terephthalate (PET) having a size of 10 cm×30 cm (as a support with a thickness of 100 μm; manufactured by Teijin Ltd.) whose one surface was coated with polyurethane, one end of the surface not coated with polyurethane was attached to a glass substrate with a double-sided adhesive tape, so as to secure the support made of the PET film onto the glass substrate.

Subsequently, 690 parts by mass of thus obtained ITO powder (having an average particle size of 30 nm) and 2,310 parts by mass of ethanol (manufactured by Kanto Chemical Co., Inc.) were mixed and stirred by a mixer, so as to yield a first mixed liquid. The first mixed liquid was put into a bead mill pulverizer (manufactured by Kotobuki Industries Co., Ltd.). Then, using 100-μm beads, pulverization was performed for 180 minutes, so as to pulverize the ITO powder. The particle size distribution of the ITO power in the resulting first mixed liquid was measured by using a measuring instrument, Microtrac UPA. As a result, the average particle size D50=60 nm. The maximum particle size D100=100 nm. The ratio of particles having a particle size of 100 nm or greater was 0.15% in the ITO powder.

The first mixed liquid was applied by bar coating onto the support and dried. Thereafter, the support coated with the first mixed liquid was peeled off from the glass substrate. A PET film (having a thickness of 50 μm; manufactured by Teijin Ltd.) was overlaid on the surface of the support coated with the first mixed liquid, and a pressure was applied thereto with a roll press having a width of 150 mm at a roll pressure of 10 MPa and a feeding rate of 5 m/min. Then, the PET film was peeled off, so as to yield an ITO powder film on the support. The thickness of thus obtained ITO film was 1 μm.

On the other hand, 20 parts by mass of ethoxylated bisphenol A diacrylate (product name: A-BPE-20 manufactured by Shin-Nakamura Chemical Co., Ltd.), 35 parts by mass of polyethylene glycol dimethacrylate (product name: 14G manufactured by Shin-Nakamura Chemical Co., Ltd.), 25 parts by mass of 2-hydroxy-3-phenoxypropyl acrylate (product name: 702A manufactured by Shin-Nakamura Chemical Co., Ltd.), 10 parts by mass of a urethane-modified acrylate (product name: UA-512 manufactured by Shin-Nakamura Chemical Co., Ltd.), 10 parts by mass of an acrylic polymer (with an average molecular weight of about 50,000, having 50 acryloyl groups and 25 triethoxysilane groups on average per molecule), and 1 part by mass of a photopolymerization initiator (ESACURE ONE manufactured by Lamberti S.p.A.) were mixed in 50 parts by mass of methylethylketone (MEK manufactured by Kanto Chemical Co., Inc.), so as to yield a second mixed liquid.

Then, the second mixed liquid was applied by bar coating onto the ITO film such that the thickness after curing became 3 μm. After the resulting product was left for 5 minutes under reduced pressure at normal temperature, the surface coated with the second mixed liquid and the PET film (support) were attached together in the air, and photopolymerization was effected from the support side. Its condition was such that the integrated illuminance was 4.0 J/cm$^2$ in the wavelength range of 300 nm to 390 nm by using a high-pressure mercury lamp as a light source.

Then, the support was separated, so as to yield a transparent conductive film.

Example 2

A transparent conductive film was obtained as in Example 1 except that the ITO powder used in Example 1 was pulverized for 180 minutes by using 30-μm beads. Here, the average particle size D50=43 nm. The maximum particle size D100=80 nm. Namely, the ratio of particles having a particle size of 100 nm or greater was 0% in the ITO powder.

Example 3

A transparent conductive film was obtained as in Example 1 except that the ITO powder used in Example 1 was pulverized for 120 minutes by using 50-μm beads. Here, the average particle size D50=58 nm. The maximum particle size D100=96 nm. Namely, the ratio of particles having a particle size of 100 nm or greater was 0% in the ITO powder.

Example 4

A transparent conductive film was obtained as in Example 1 except that the ITO powder used in Example 1 was pulverized for 180 minutes by using 50-μm beads. Here, the average particle size D50=45 nm. The maximum particle size D100=96 nm. Namely, the ratio of particles having a particle size of 100 nm or greater was 0% in the ITO powder.

Comparative Example 1

A transparent conductive film was obtained as in Example 1 except that the ITO powder used in Example 1 was pulverized for 60 minutes by using 50-μm beads. Here, the average particle size D50=65 nm. The maximum particle size D100=120 nm. The ratio of particles having a particle size of 100 nm or greater was 2.15% in the ITO powder.

Comparative Example 2

A transparent conductive film was obtained as in Example 1 except that the ITO powder used in Example 1 was pulverized for 120 minutes by using 100-μm beads. Here, the average particle size D50=70 nm. The maximum particle size D100=100 nm. The ratio of particles having a particle size of 100 nm or greater was 0.24% in the ITO powder.

[Evaluation Method]

Optical Properties

Each of the transparent conductive films obtained by Examples 1 to 4 and Comparative Examples 1 to 2 was cut into a 50-mm square, and the total light transmittance and haze value were measured by a turbidimeter (NDH2000 manufactured by Nippon Denshoku Industries Co., Ltd.) at a predetermined measurement point in the ITO surface. Table 1 shows thus obtained results.

Electric Properties

In the following manner, electric resistance was evaluated in each of the transparent conductive films obtained by Examples 1 to 4 and Comparative Examples 1 to 2. Namely, each of the transparent conductive film obtained as mentioned above was cut into a 50-mm square, and the surface electric resistance value was measured by a 4-terminal, 4-probe surface resistivity meter (MCP-T600 manufactured by Mitsubishi Chemical Corporation) at a predetermined measurement point in the ITO surface. Table 1 shows thus obtained results.

| | SURFACE RESISTANCE VALUE kΩ/□ | TOTAL LIGHT TRANSMITTANCE % | HAZE VALUE % |
|---|---|---|---|
| EXAMPLE 1 | 3.45 | 89.2 | 2.2 |
| EXAMPLE 2 | 3.57 | 90.2 | 1.6 |
| EXAMPLE 3 | 3.62 | 89.4 | 2.1 |
| EXAMPLE 4 | 3.24 | 89.7 | 1.9 |
| COMPARATIVE EXAMPLE 1 | 2.93 | 86.4 | 5.1 |
| COMPARATIVE EXAMPLE 2 | 3.16 | 86.9 | 4.5 |

As Table 1 clearly shows, Examples 1 to 4 were found to be better in total light transmittance and haze value than Comparative Examples 1 to 2. The foregoing results have verified that the transparent conductor of the present invention can provide a transparent conductor and a transparent conductive film which are excellent in light transmittance and haze value.

What is claimed is:

1. A touch panel comprising:

a transparent conductive film, wherein said transparent conductive film comprises a support and a transparent conductor provided on said support, wherein said transparent conductor contains conductive particles and a binder, wherein said conductive particles have an average particle size of 60 nm or smaller, wherein the number of conductive particles having a particle size of 100 nm or greater is 10% or less of the total number of conductive particles, and wherein the binder is selected from the group consisting of acrylic binders, epoxy binders, polystyrene, polyurethane and fluorine binders.

2. A touch panel according to claim 1, wherein the number of conductive particles having a particle size of 40 to 80 nm is 50% or greater of the total number of conductive particles.

3. A touch panel according to claim 2, wherein the average particle size is 10 nm or greater.

4. A touch panel according to claim 1, wherein the average particle size is 10 nm or greater.

* * * * *